United States Patent [19]

Marforio

[11] 4,066,027

[45] Jan. 3, 1978

[54] WORKPIECE FEEDER DEVICE FOR THE TRAVELING GRIPPER OF A SEWING UNIT

[75] Inventor: Nerino Marforio, Milan, Italy

[73] Assignee: Rockwell-Rimoldi S.p.A., Milan, Italy

[21] Appl. No.: 681,914

[22] Filed: Apr. 30, 1976

[30] Foreign Application Priority Data

May 14, 1975 Italy ..... 23309/75

[51] Int. Cl.[2] ..... D05B 21/00

[52] U.S. Cl. ..... 112/121.15; 112/121.26

[58] Field of Search ..... 112/121.26, 121.15, 112/203, 136, 153, 121.11, 121.12, DIG. 2, DIG. 3

[56] References Cited

U.S. PATENT DOCUMENTS

| | | | |
|---|---|---|---|
| 3,463,101 | 8/1969 | Ansel | 112/121.15 |
| 3,713,408 | 1/1973 | Deeks et al. | 112/121.26 X |
| 3,759,200 | 9/1973 | Marforio | 112/121.15 |
| 3,903,818 | 9/1975 | Marforio | 112/121.15 |

*Primary Examiner*—Werner H. Schroeder
*Assistant Examiner*—Peter Nerbun

[57] ABSTRACT

A workpiece feeding device for presenting a workpiece to a sewing units traveling gripper for each sewing cycle having a sensing element for detecting the presence of the gripper in its starting position. The device includes actuating mechanisms operatively associated therewith for pivoting the gripper to a position to engage the workpiece and for closing the gripper so that it will grip and tension the workpiece during the sewing cycle as it is advanced along the sewing surface by the sewing machine during the sewing operation.

10 Claims, 6 Drawing Figures

WORKPIECE FEEDER DEVICE FOR THE TRAVELING GRIPPER OF A SEWING UNIT

BACKGROUND OF THE INVENTION

The present invention relates to a workpiece feeder device for a traveling gripper means in a sewing unit.

As is well known, the aforementioned gripper means is used to grip superimposed pieces of fabric constituting the workpiece to be sewn to keep the edges matched together and also to keep them on the sewing surface of the unit as the workpiece is moved towards the sewing machine.

It is necessary for the pieces of fabric to be gripped in this way for various reasons, for example, because of pattern defects, as a result of preceding sewing operations, and also as a result of the fact that the pieces of fabric are cut in large numbers at one time using suitable cutting means. As a result of these defects, differences occur in the dimensions of the pieces of fabric which make it necessary to match the pieces correctly after suitable tensioning to make the two pieces the same length. Thereafter, the pieces of fabric which have been correctly positioned one on top of the other in the aforementioned manner are gripped by the gripper means and inserted beneath the presser foot of the sewing machine.

Gripper devices are already known wherein the traveling gripper means moves freely on the sewing surface to accompany the workpiece as it is being sewn.

Quite obviously, when devices of the above type are used, the operator must wait until the traveling gripper means returns to its starting position before a fresh workpiece can be gripped.

The object of the present invention is to improve the features of the above-mentioned known devices by providing means which are designed to eliminate the aforementioned waiting time which unfavorably influences the entire operating cycle of the sewing unit. The technical problem to be solved is that of employing the translational movement of the traveling gripper means towards the sewing machine and its return movement towards the position where the workpieces are gripped, for the purpose of placing a fresh workpiece in a position in which it can be gripped by the gripper means when the latter returns to its starting position.

SUMMARY OF THE INVENTION

The solution to this technical problem is provided by a feeder device of the aforementioned type wherein a workpiece positioning means is disposed adjacent to the starting point for the traveling gripper means formed by a shock absorber. The feeder device according to the present invention comprises the following elements: sensing means for indicating the presence of the traveling gripper means and for initiating the operation of gripping the workpiece; displacement means for moving the traveling gripper means from a particular arrival position towards the positioning means; closing means for closing the gripper means on the end of the workpiece upon reaching the actual gripping position.

One of the advantages of the present invention is that of being able to automatically grip one workpiece after the other with the traveling gripper means after having positioned the workpiece correctly on the feeder device.

Other objects, features and advantages of the present invention will be made apparent from the following detailed description thereof which is provided with reference to the accompanying drawings, in which:

DESCRIPTION OF THE PREFERRED EMBODIMENT

Figure 1:
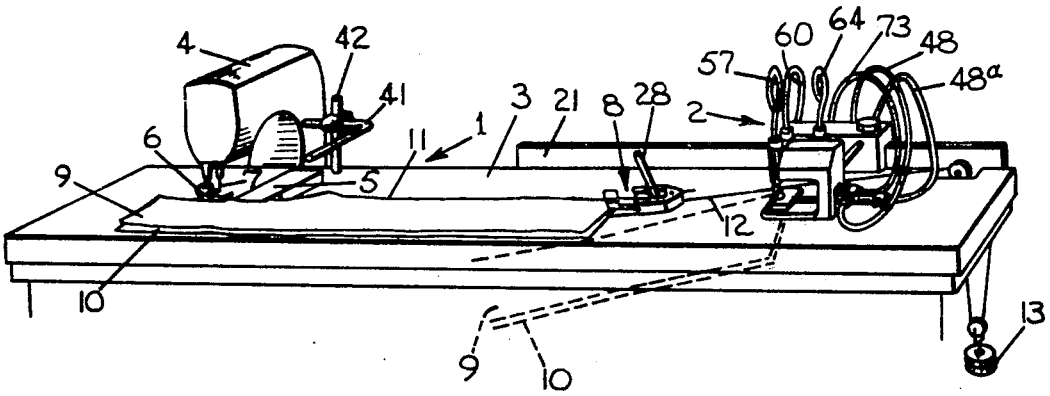
FIG. 1 is a perspective view of the feeder device on a sewing unit.

With reference to FIG. 1, the sewing unit 1 with which the present feeder device 2 is used consists essentially of a work or sewing surface 3, at one end of which is mounted a sewing machine 4 comprising a work guide 5, a presser foot 6 and a needle bar 7 which cooperate with known sewing and feeding elements (not shown). A traveling gripper means 8 is slidably mounted on the sewing surface and it grips one of the ends of the two superimposed pieces of fabric constituting the workpiece which is to be sewn along the edge 11 of each piece of fabric. These edges 11 should fit together and be well matched at the end of the sewing operation.

Return means 13 consisting of a number of replaceable counter-balance elements are connected to the gripper means by a cable 12. The return means is used to return the gripper means to a positioning element or starting point which includes a shock absorber 14 (FIG. 3) that is adjustably mounted on a support member 15 disposed at the opposite end of the sewing surface 3 from the sewing machine.

The shock absorber 14 carries two divergent tongues 16 which are directed towards the sewing machine and which are adapted to receive the traveling gripper means 8. The shock absorber 14 also includes a guide element 17 across which the cable 12 is freely slidable. The cable 12 is operatively associated with a pulley 18 that is mounted in an opening 19 provided in the sewing surface and which is adapted to cause the cable to move beneath the latter where it is weighed down by the counter weights 13. The end of the cable is suitably attached beneath the sewing surface.

The shock absorber 14 is attached to a rod 20 that is adjustably mounted on the aforementioned support member 15 which in turn is mounted on a rail 21 in a suitable position relative to the sewing machine.

This support member 15 includes a knob 22 for locking the rod 20 in a desired position. The means for securing the support member 15 on this rail will be described hereinafter.

Figure 4:
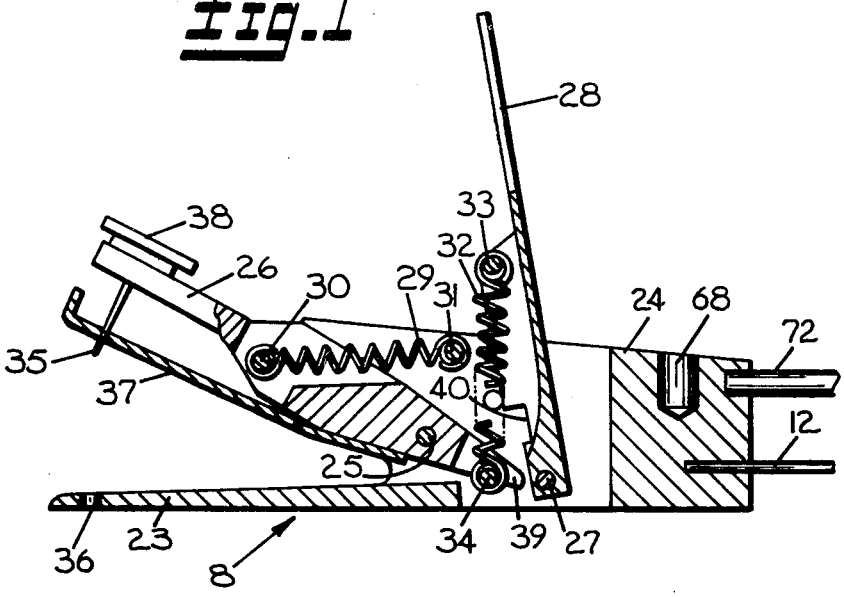
FIGS. 4 and 5 are diagrammatic views of two features of the traveling gripper means.

Referring now to FIG. 4, the traveling gripper means 8 is provided with a sliding block 23 supported by the sewing surface 3 and of an element 24 to which one end of the cable 12 is connected and on which a movable jaw 26 is pivotably mounted at 25 and an opening lever 28 at 27.

A first return spring 29 which is anchored at 30 and 31, respectively, which connects the movable jaw 26 with element 24 and a second return spring 32 which is anchored at 33 and 34, respectively, to connect the opening lever 28 with said element 24.

On the projecting end of the element 24 the movable jaw 26 carries a pin 35 which is adapted to penetrate the workpiece and, consequently, to penetrate a hole 36 provided in the sliding block 23 when the pieces of fabric 9 and 10 are gripped. To keep the pieces of fabric in position, pressure is exerted on the latter by a flexible plate 37 which is secured beneath the movable jaw 26 and through which the pin 35 extends.

A head 38, on which pressure is exerted to close the movable jaw 26, is disposed above the pin 35. In the closed position, the opposite end 39 of the jaw 26 is inserted in a recess 40 of the lever 28 and is held there by virtue of the position which the latter is caused to assume as a result of the action of the return spring 32.

Figure 5:
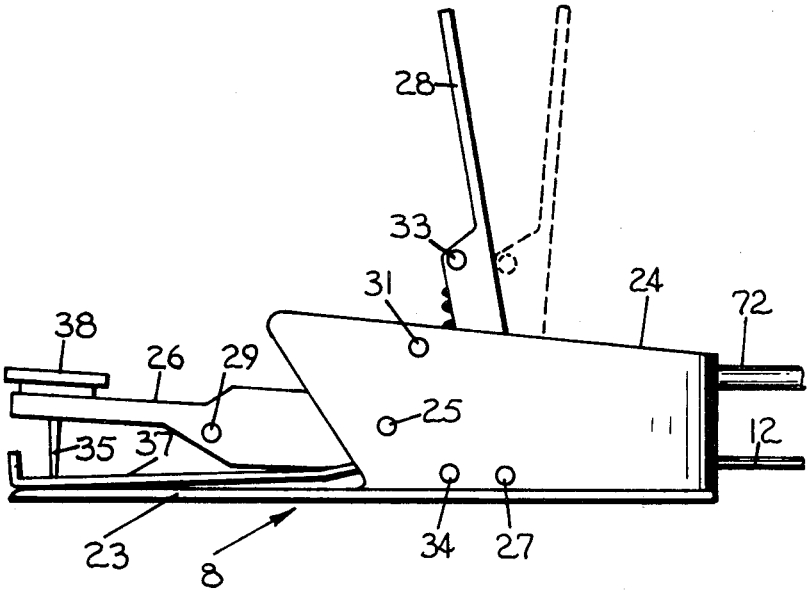

The lever 28 is moved to the right to the dotted line position shown in FIG. 5 when the gripping means per se reaches the end of its travel in the vicinity of the sewing machine 4, more precisely, when said lever 28 engages a horizontal bar 41 (FIG. 1) provided on a vertical support 42 that is attached to the sewing surface 3.

As a result of the dragging motion produced by the workpiece, the lever 28 is moved by the horizontal bar against the action of the return spring 32, which releases the jaw 26 from the cavity 40 and the jaw opens as a result of the returning action of the spring 29.

Figure 2:
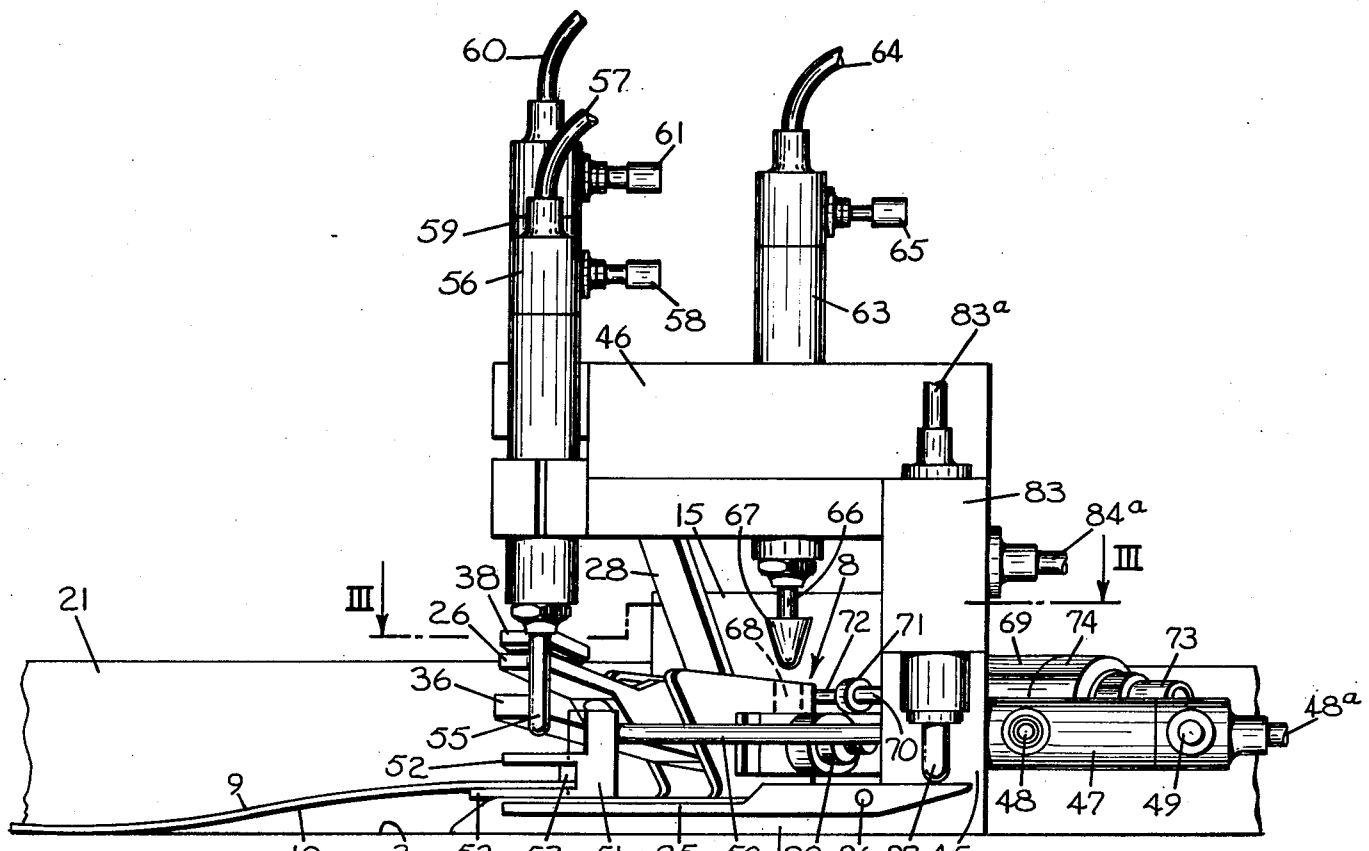
FIG. 2 is an enlarged elevational view of the feeder.
Figure 3:
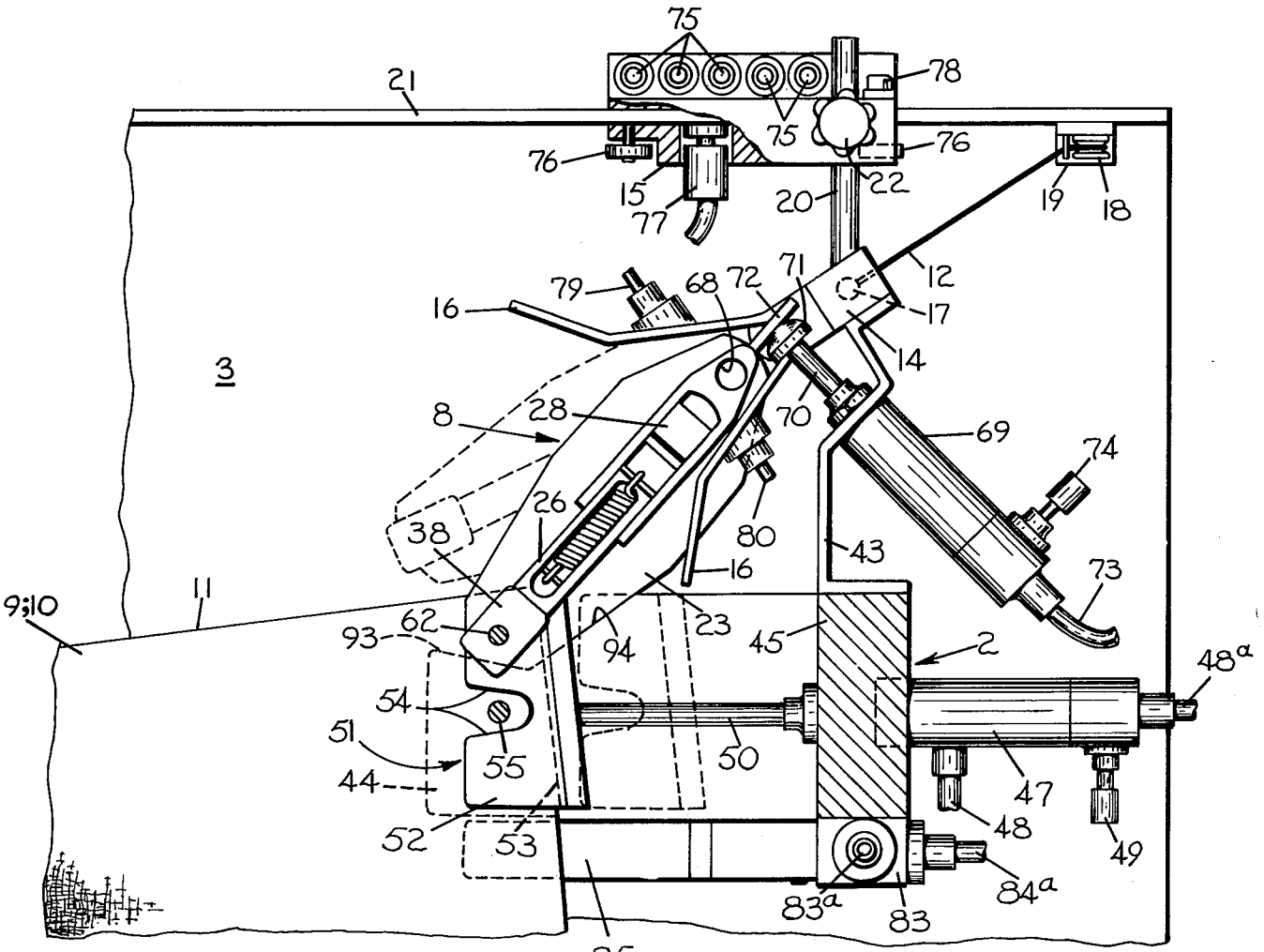
FIG. 3 shows a section along the line III—III in FIG. 2.

The feeder device 2 having a base plate 44 supported on the sewing surface 3 includes a vertical stand 45 disposed at one end of the base plate 44 and a bracket 46 (FIG. 2) attached to the body of the shock absorber 14 by means of a plate 43 (FIG. 3). A pneumatic cylinder 47 comprising ports 48 and **48*a* for controlling intake and release of air and also a pressure regulator 49 is attached to the vertical stand 45 and is disposed parallel to the base plate 44. A piston (not shown) is provided within the cylinder 47. A rod 50 operatively connected to the piston supports a positioning means or body member 51 provided with a groove formed by two parallel walls 52 and a check wall 53** which is angularly disposed with respect to the direction of displacement of the workpiece at an angle greater than 90° to prevent the new workpiece which has been inserted in this positioning element from interfering with the workpiece being sewn.

Both of the walls 52 include a cavity 54 (FIG. 3) through which a clamping means 55 formed by the actuating rod of a piston (not shown) slidable in a pneumatic cylinder 56 and attached to the free end of the bracket 46 is movable. The cylinder 56 comprises an air intake port 57 and a pressure regulator 58.

Immediately adjacent to cylinder 56 there is provided another pneumatic cylinder 59 which includes an air intake port 60, a pressure regulator 61 and a piston (not shown) with its actuating rod 62 extending downwardly (FIG. 2). Another pneumatic cylinder 63 having an air intake port 64 and a pressure regulator 65 is also mounted on bracket 46 as shown in FIG. 2. This cylinder also includes a piston, the actuating rod 66 of which is provided at its lower end with a conical plug 67 that is adapted to partially penetrate a hole 68 provided in the upper and rear part of the traveling gripper means 8, and provides a point of rotation for the latter. A pneumatic cylinder 69, supported by plate 43 includes an actuating rod 70 on which a drive member 71 is carried and which is directed towards a horizontal rod 72 projecting from the rear portion of the traveling gripper means 8 for initiating the aforementioned rotational movement.

This pneumatic cylinder 69 also includes an air intake port 73 and a pressure regulator 74. The plug 67 and the drive member 71 together with their particular pneumatic cylinders constitute the displacement means that is adapted to move the traveling gripper means 8 from any particular arrival position with respect to the shock absorber 14, such as the dotted line position in FIG. 1, towards the base plate 44 where it is in position for gripping the next workpiece to be sewn.

The support member 15 includes a plurality of air distributing ports 75 which provide air to the various pneumatic cylinders described above through suitable connections (not shown) with the air intake ports of said cylinders.

The support member 15 also includes a pair of slide rollers 76 (FIG. 3) which engage the sewing surface 3 and facilitate movement of the support along the rail 21. The support can be stopped on the rail 21 by means of a pneumatic piston 77 which is suitably connected to a push button 78 which when actuated will apply a braking force on the rail when it is necessary for the operator to change the position of the feeder device 2 with respect to the sewing machine. A change of this nature is necessary when there is a change in the length of the seams to be sewn. For example, the feeder device is positioned further away from the sewing machine when the seams on the outer part of the pants are to be sewn and it is positioned close to the sewing machine when the seams on the inner part of the pants are sewn.

Sensing means for indicating the presence of the traveling gripper means 8 are provided on the divergent tongues 16 of the shock absorber 14. The sensing means includes light source 79 and a photo-sensitive diode 80 suitably connected to the pneumatic control circuit. Obviously, the sensing means can consist of a fluid switch or a conventional micro-switch.

Figure 6:
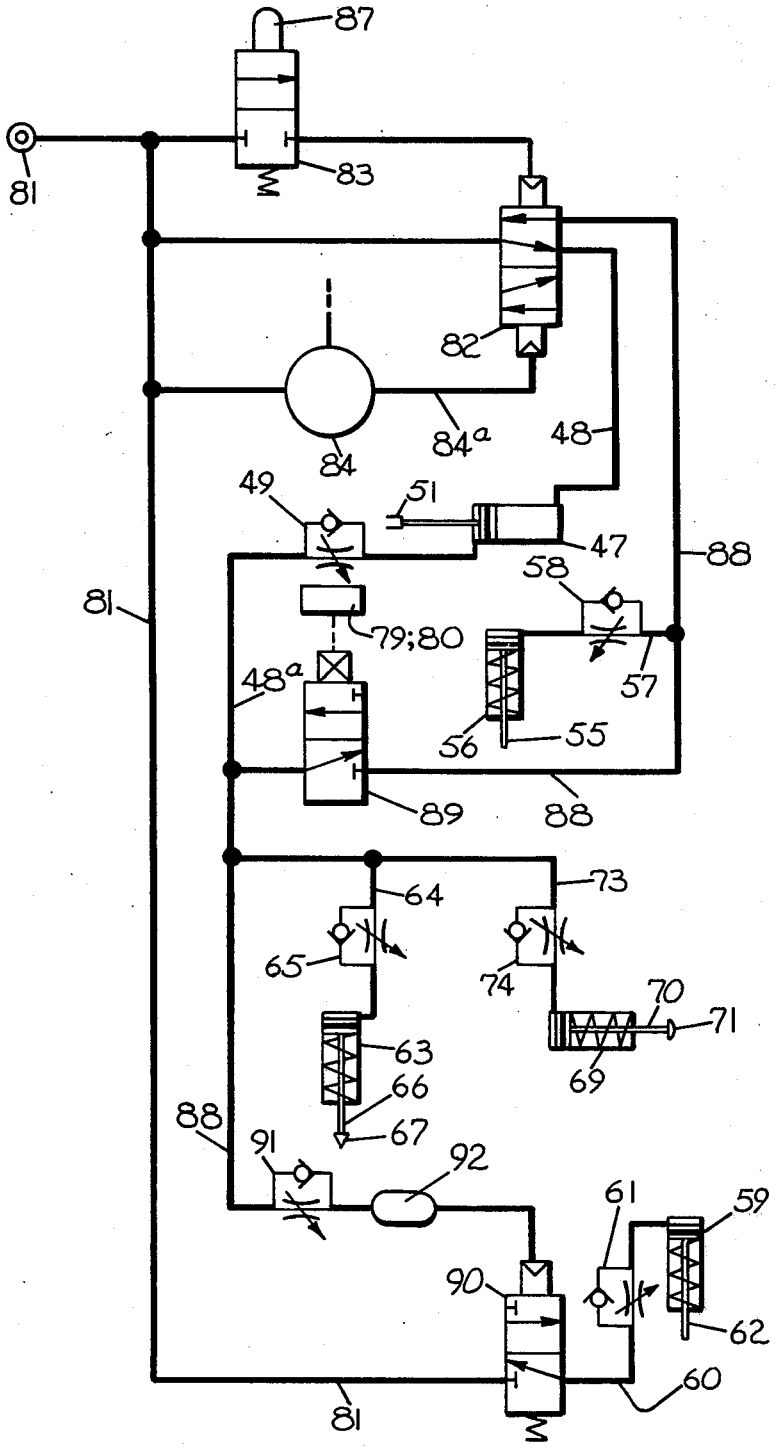
FIG. 6 is a diagram of the pneumatic control circuit of the feeder device.

The pneumatic control circuit (FIG. 6) is provided with a conventional supply line 81 which supplies compressed air to a distributor housing 82 and simultaneously to a valve 83 and a pulse emitter 84. The valve 83 is actuated manually by the operator by means of a control element consisting of a lever 85 (FIGS. 2 and 3) hinged on a pin 86 that is secured to the base plate 44. One of the ends of the lever 85 is disposed in the position of the workpiece insertion zone and the other end is in contact with an actuating element 87 of the valve 83. Th pulse emitter 84 (FIG. 6) is suitably connected to a conventional sewing machine starting device so that it is activated by the latter at the beginning of each sewing operation, thereby causing it to emit a single short control pulse. The valve 83 and the pulse emitter 84 are utilized to change the operating position of the aforementioned distributor housing 82. The latter supplies the air intake port 48 of the pneumatic cylinder 47 in the normal manner for maintaining the positioning means 51 in its position for receiving the workpiece which is to be gripped and sewn.

A second line 88 in which there is inserted an electrovalve 89 connected to the sensing means 79 and 80, also leads from the distributor housing 82.

The air intake port 57 of the pneumatic cylinder 56 is connected upstream of the electrovalve 89.

Downstream of the electrovalve 89 the line 88 supplies the remaining pneumatic cylinders 63 and 69 by way of their respective air intake ports. It supplies the aforementioned pneumatic cylinder 47 through the air intake port **48*a* from the opposite side to the air intake port 48 in order to move the positioning means 51 into the non-operative position when this is required. Finally, the line 88 actuates a valve 90 by means of a stroke regulator 91 and a pneumatic reservoir 92. The valve 90 is inserted between the supply line 81 and the air intake 60 of the pneumatic cylinder 59**.

During each automatic cycle of the sewing machine the traveling gripper means moves away from the feeder device 2 so that it can follow the workpiece which is being sewn. Thereafter it will return to its starting point.

During the time required to complete the sewing operation on one workpiece, the operator inserts one end of the pieces of fabric of the next workpiece in the positioning means 51, taking care to ensure that the ends are placed against the check wall 53.

After completing this operation the operator presses the lever 85 to move the actuating element 87 of the valve 83 which, by means of a conduit 83*a*, causes the distributor housing 82 to be displaced in such a way as to discharge the compressed air contained in the pneumatic cylinder 47 of the positioning means 51. The latter is arrested in its first position, but the pneumatic cylinder 47 which has been deprived of air is ready for the succeeding operation which is that of moving the positioning means 51 away from the traveling gripper means 8, as shown by the dotted line in FIG. 3, to avoid any interference with the pin 35 of the gripper means at the particular moment when the workpiece is being gripped. Simultaneously therewith, the pressure on the lever 85 causes the compressed air to be introduced into the line 88 so as to actuate the clamping means 55. In this way the actuating rod of the pneumatic cylinder 56 passing through the cavity 54 presses and holds the pieces of fabric 9 and 10 on the base plate 44. After being released from the workpiece by the horizontal bar 41 which acts on the lever 28 the traveling gripper means 8 returns to its starting point against the shock absorber 14 between the divergent tongues 16. In this position the gripper means actuates the photodiode 80 which causes the cycle involving the feeding and gripping of the workpiece to start automatically through the actuation of the electrovalve 89 which allows compressed air to pass into the air intake 48*a*, 64 and 73. It also enables compressed air to pass into the reservoir 92 through the sequential actuation of the pneumatic cylinders 47, 63 and 69 and also of the valve 90 through the supplying of air to the penumatic cylinder 59. The pneumatic cylinder 47 causes the positioning means 51 to move away from the position described previously without taking with it the workpiece which is held in position by the clamping means 55.

The pneumatic cylinder 63 is effective in moving the conical plug 67 downwardly into the hole 68 in the traveling gripper means 8, thereby forming a point about which it can be rotated by means of the action of the drive member 71 of the pneumatic cylinder 69 on the base plate 44. This operating stage results in the end of the workpiece being freely disposed between the movable jaw 26 and the sliding block 23. Lastly, the pneumatic cylinder 59 moves its actuating rod 62 into engagement with the head 38 of the movable jaw 26, thus acting as a closing means for the traveling gripper means 8.

In the meantime, the operator will have proceeded to match together the other ends of the pieces of fabric and to place them under the presser foot 6 so as to make it possible to commence a new sewing operation. When the device for starting the sewing machine is activated it causes the pulse emitter 84 to be activated and the latter sends a compressed air pulse through its conduit 84*a*, thereby causing the distributor housing 82 to be displaced in the opposite direction, thus cutting off the supply to the line 88. As a consequence, the re-entry of the actuating rods of the cylinders with which the line 88 is connected also causes the pneumatic cylinder 47 to be supplied by way of the air intake port 48, thus causing the positioning means 51 to move into position for receiving a fresh workpiece.

The sequential operation of all the cylinders is obtained by appropriate adjustment of their respective pressure regulators. More particularly, the closing of the traveling gripper means 8 is regulated both by the stroke regulator 61 and the pneumatic reservoir 92 which determines the moment of operation.

According to a possible variant, the positioning means 51 can be provided in a fixed position on the base plate 44.

However, in this case the positioning means would have to be formed on the side of the traveling gripper means 8 similar to that of the base plate 44 which comprises a recess (FIG. 3) formed by two inclined walls 93 and 94, within which the gripper means may be disposed for the purpose of gripping the workpiece.

The disposition of the walls 93 and 94 is such as not to constitute an obstacle to the free movement of the traveling gripper means 8 which adopts a more suitable position for following the workpiece towards the sewing machine as soon as the workpiece begins to move. In the course thereof it makes a partial rotation on itself in the opposite direction to that provided by the positioning means.

The pneumatic actuation means and also the control circuit can be placed by electromagnets and by an associated electric supply circuit without departing from the scope of the present invention.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A workpiece feeder device for a traveling gripper movable while holding and tensioning a workpiece being advanced along the work surface of a sewing unit by the feeding elements of a sewing machine mounted adjacent one end thereof, said workpiece feeder device comprising:

a. a support member mounted on the sewing unit adjacent that end opposite the end supporting the sewing machine;

b. means defining a positioning element carried by said support member for receiving and locating the traveling gripper at the completion of each sewing cycle;

c. a workpiece positioning means carried by said support member in a position immediately adjacent to said positioning element for locating the trailing end of a workpiece in readiness for the next sewing cycle;

d. means operatively associated with said workpiece positioning means for clamping the workpiece located thereby;

e. means connected to said support member and operatively connected to said workpiece positioning means for moving the latter to a position spaced from said workpiece being held by said clamping means;

f. displacing means carried on said support member and operatively connected to said positioning element for pivoting the traveling gripper located therein to a position for engaging the workpiece; and g. closing means mounted on said support member for engaging the traveling gripper and closing the same to effect gripping of the workpiece held by said clamping means prior to the start of the sewing cycle.

2. The workpiece feeder device according to claim 1 wherein said device includes a pneumatic control circuit for actuating each said clamping, moving, displacing and closing means in timed sequence with the sewing cycle.

3. The workpiece feeder device according to claim 1 wherein said workpiece positioning means includes a body member having a pair of spaced parallel walls extending therefrom between which one end of a workpiece is positioned.

4. The workpiece feeder device according to claim 2 wherein said pair of spaced parallel walls are interconnected by a check wall for engaging the end of a workpiece at an angle to prevent interference between the latter and that workpiece in the process of being sewn.

5. The workpiece feeder device according to claim 2 wherein said clamping means includes a pneumatic cylinder having an actuating rod for engaging and holding the workpiece in that position provided by said workpiece positioning means.

6. The workpiece feeder device according to claim 2 wherein said moving means includes a pneumatic cylinder having an actuating rod operatively connected to said workpiece positioning means.

7. The workpiece feeder device according to claim 2 wherein said displacing means includes a sensing means for detecting the presence of the traveling gripper in said positioning element and for initiating actuation of said displacing means.

8. The workpiece feeder device according to claim 7 wherein said sensing means includes a light source and a photo-sensitive diode operatively associated therewith.

9. The workpiece feeder device according to claim 6 wherein said displacing means includes a pneumatic cylinder with a drive member carried on the actuating rod thereof for pivoting the traveling gripper to its workpiece engaging position.

10. The workpiece feeder device according to claim 9 wherein said displacing means includes a pneumatic cylinder with a conical plug carried on the actuating rod thereof and movable into operative engagement with the traveling gripper to provide a fulcrum point therefor during its pivotal movement by said displacing means.

* * * * *